US005236328A

United States Patent [19]

Tate et al.

[11] Patent Number: 5,236,328

[45] Date of Patent: Aug. 17, 1993

[54] OPTICAL FLAME DETECTOR PERFORMANCE TESTER

[75] Inventors: George J. Tate, Edina; Paul E. Sigafus, Medina, both of Minn.

[73] Assignee: Honeywell Inc., Minneapolis, Minn.

[21] Appl. No.: 948,032

[22] Filed: Sep. 21, 1992

[51] Int. Cl.[5] ..... F23N 5/26

[52] U.S. Cl. ..... 431/14; 431/24; 431/79

[58] Field of Search ..... 431/24, 26, 79, 14

[56] References Cited

U.S. PATENT DOCUMENTS

| | | | |
|---|---|---|---|
| 3,324,927 | 6/1967 | Staring | 431/24 |
| 4,280,184 | 7/1981 | Weiner et al. | 364/506 |
| 4,328,527 | 5/1982 | Landis | 361/175 |
| 4,713,819 | 12/1987 | Yoshikawa | 372/9 |
| 4,823,114 | 4/1989 | Gotisar | 431/24 |
| 4,827,351 | 5/1989 | Sakamoto | 358/284 |
| 4,955,806 | 9/1990 | Grunden et al. | 431/69 |
| 5,077,550 | 12/1991 | Cormier | 431/79 |

*Primary Examiner*—Carroll B. Dority
*Attorney, Agent, or Firm*—Edward Schwarz

[57] ABSTRACT

A burner control system periodically tests for and detects an out of range signal level from a flame sensor in the burner. When the system is in standby operation where no flame is present, the control system checks whether the flame signal level is within an abnormal range defined by a low margin level and a threshold level. When the system is in an operational phase where flame is expected, the system checks whether the flame signal level is within an abnormal range defined by a high margin level and the threshold level. Should either check detect the flame signal within an abnormal range, a signal is provided indicating this abnormal condition. Preferably, the abnormal condition is used to control the flashing of an indicator light, fast during standby phase if the flame signal level is too close to the threshold level and more slowly if the flame signal level is too close to the threshold level while flame is present. It is also possible to use two different lights for the indicators.

14 Claims, 3 Drawing Sheets

OPTICAL FLAME DETECTOR PERFORMANCE TESTER

BACKGROUND OF THE INVENTION

That burner systems are used in a variety of applications such as building heating systems, industrial processes, power generation, etc. goes without saying. Typically, newer burner systems use microprocessor-based controls because of the reliability, economy, flexibility, efficiency, and capability microprocessors provide. The microprocessor receives numerous signals indicating various conditions relating to burner operation and provides control signals to the burner system which cause each of the various burner system functions to be initiated and terminated properly. The microprocessor also receives demand signals arising externally which specify when the burner system should operate and perhaps the level of combustion required as well. When heat is needed, the microprocessor issues a number of commands to the burner system which cause the burner system to pass through a sequence of operating phases which prepare the burner system for the run phase which denotes combustion of fuel flowing through the main valve. Just before the run phase, there is a pilot phase, during which the pilot valve is open and the pilot light is burning. The pilot light is used to light the main valve fuel as the burner system moves into the run phase. During the run and pilot phases, the microprocessor provides a standby signal having a first state and during other phases of operation the standby signal has a second state, the term "standby" in this context denoting that there is no flame within the combustion chamber.

It is of supreme importance that burner system operation be managed safely, and one of the key aspects of this requirement is that fuel be supplied to the burner system's combustion chamber only when a flame is actually present. A flame sensor is employed to assure that flame is present whenever either of the fuel valves are open. If the flame sensor should indicate absence of flame while the standby signal has its second state, then any open fuel valve is closed immediately to prevent unburned fuel from accumulating.

A common type of flame sensor used for electronic burner system controls senses the ultraviolet radiation from the combustion process and provides an electronic flame signal having an analog value increasing and decreasing as the radiation impinging on the sensor increases or decreases. This analog value may take a number of different forms such as a voltage or current level or the duration between level changes in the signal. In a particular system now available from the assignee of this application, a specific level of the value encoded in the sensor signal is defined as a threshold level indicating presence of flame. In this embodiment, current level has been chosen to forms the flame signal with 0.8 μamp. as the threshold level. Flame sensor current greater than this amount is interpreted as indicating presence of flame. Current less than this amount is interpreted as absence of flame.

Because of the nature of the sensor and the environment within combustion chamber, there is a tendency for their performance to deteriorate or degrade over a period of time. Because the deterioration tends to increase the signal level when no flame is actually present, there is the potential for the unsafe condition to arise of flame indicated by the flame signal when in fact no flame is present. In fact, however, procedures have been developed for assuring that flame is not incorrectly indicated as present. These procedures can detect when the signal provided by the flame sensor has finally become unreliable.

Flame sensor operation can deteriorate or become marginal for a number of reasons such as degradation of the sensor's internal elements, or dust and moisture which affects operation. The ability to detect both the pilot flame and the main flame at the appropriate times in the burner startup sequence requires precise initial alignment of the flame sensor and competent maintenance thereafter. When flame sensor operation deteriorates in this way for any reason, nuisance shutdowns may occur because of failure to detect the presence of a flame which is actually present.

This deterioration of a flame sensor is a gradual process which eventually results in its signal shifting out of the ranges specified for presence or absence of flame when the particular condition exists. This deterioration requires sensor replacement or maintenance when the erroneous signal causes the control system to unnecessarily shut down the burner system. Delaying replacement or maintenance may cause these nuisance shutdowns to occur at a time when the repair will be expensive or inconvenient. Accordingly, it would be useful to determine sensor deterioration before actual sensor signal failure occurs and while flame sensor operation is still safe.

BRIEF DESCRIPTION OF THE INVENTION

These problems of flame sensor operation in a burner system can be detected before the problem causes nuisance shutdown of the system with the resulting inconvenience and expense. Normally, the sensors now in use provide a signal which is substantially greater than the threshold level when flame is present and substantially less than the threshold level when flame is not present. The solution to this problem is an improvement which at appropriate times depending on the condition of the standby signal, senses drifting of the sensor signal level into one of the ranges which is adjacent to the threshold level. Presence of the sensor signal in the adjacent range may be used to indicate abnormal performance of the flame sensor with a first state of a sensor performance signal. The first state of the sensor performance signal can be used to trigger some sort of visual or audible indication which will alert the operator to service the flame sensor during scheduled maintenance of the burner system.

While it is possible to implement this improvement with individual logic and circuit elements, it is much more efficient to simply program the microprocessor already present in the system to perform these sensor abnormality detection functions. It is well known to electronic system designers how to replicate hardware functions in software within a microprocessor. The particular mode, hardware or software, of implementing these functions is a simple matter of design choice and will be considered as fully equivalent hereafter.

This improvement includes a signal level detector receiving the flame sensor signal and providing a test signal responsive to the flame sensor signal falling within a signal level range defined at one end by the flame threshold level and at the other end by a test level displaced by a predetermined amount from the flame threshold level. Logic means receive the test and standby signals. Responsive to concurrence of a predetermined state of the standby signal and the test signal, the logic means issue the sensor performance signal with its first state. The sensor performance signal has its second state otherwise. In a software implementation, the flame sensor signal is converted to a digital value by some analog to digital device well known to those familiar with control system design. In a hardware implementation, an operational amplifier may compare the flame sensor signal level with threshold and test levels generated by a divider network and provide a logic level output which varies depending on the relationship between the flame sensor signal and the threshold and test levels.

There are two different tests available for the sensor signal. Each tests a different marginal condition of the signal. When the burner system is in standby or prepurge mode (not in run mode) and the flame sensor level falls between the threshold level and a test level smaller than the threshold level, this is a marginal condition indicating deterioration of the ability of the flame sensor to distinguish between presence and absence of flame. When the burner system is in run (operating) mode and the flame sensor level falls between the threshold level and a test level greater than the threshold level, this is a marginal condition indicating either misalignment of the flame sensor or for certain types of flame sensors, deterioration of operation.

Accordingly, one object of this invention is to sense impending malfunction of the flame sensor in a burner control system.

Another object of this invention is to improve the speed and accuracy of aligning a flame sensor for a burner system.

A further object of this invention is to reduce nuisance shutdowns of burner systems.

Yet another object of this invention is to selectively replace or adjust flame sensors during scheduled burner system maintenance only when operation is likely to become marginal before the next maintenance, thus avoiding the expense of unneeded sensor replacement or adjustment, or of emergency repairs.

DESCRIPTION OF THE PREFERRED EMBODIMENTS

Figure 1:
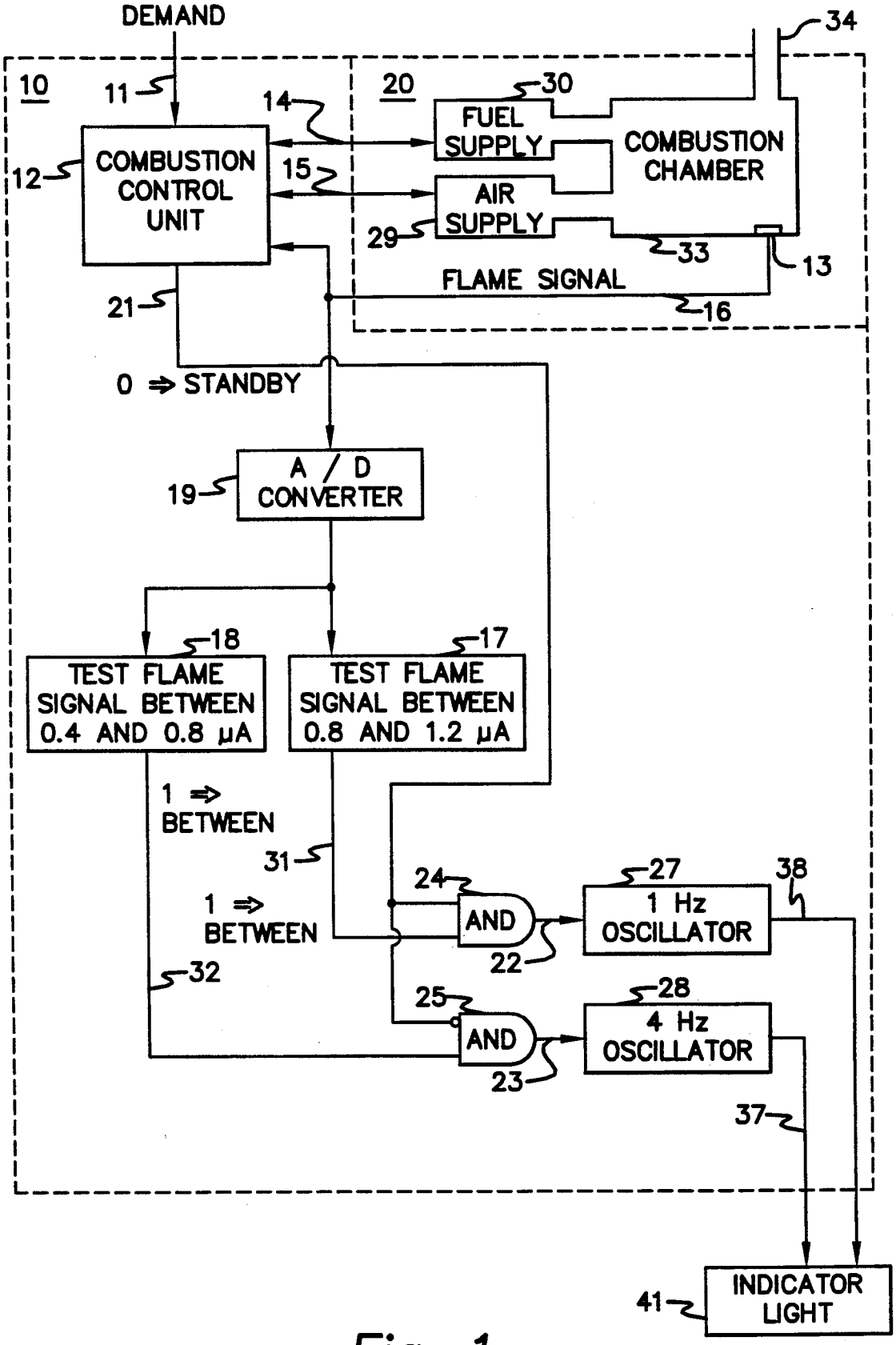
FIG. 1 is a block diagram of the hardware elements of a control system in which the invention can be implemented.

The apparatus of FIG. 1 shows a microprocessor-based burner control system 10 and the indicator light or other element 41 necessary to implement the invention. Burner system 20 is controlled by the control system 10. Control system 10 includes a combustion control unit 12 which receives a demand signal on a path 11 specifying the time and amount of heat to be provided by the burner system 20. Combustion control unit 12 forms a part of microprocessor control system 10 and will typically arise from the execution of a part of the software within the microprocessor of system IC. Communication between control unit 12 on the one hard and the fuel supply unit 30 and the air supply unit 29 on the other occurs on signal paths 14 and 15 respectively which can be generally considered to be bi-directional paths with each signal path typically comprising a number of individual conductors. Thus commands are provided to supply units 29 and 30 by control unit 12 on paths 14 and 15 and burner system status data is provided to control unit 12 on paths 14 and 15. Fuel supply 30 and air supply 29 are controlled by control unit 12 so as to efficiently and safely start and maintain combustion in combustion chamber 33.

A single operation cycle comprises a number of distinct phases each defined by the combination of signals on paths 14 and 15. Combustion gasses generated within combustion chamber 33 during presence of flame exit through flue 34. A flame sensor 13 provides a flame signal on path 16 to control system 10. A level of this flame signal above a threshold is interpreted, as was mentioned above, as presence of flame. It is typical that the flame signal respectively increases and decreases in magnitude with increasing and decreasing levels of radiation from flame within combustion chamber 33, and this will be assumed in the following discussion. If the flame signal level is inversely related to the level of radiation, the invention is still applicable, but the sense of certain values will have to be reversed, as will be mentioned.

A standby signal provided by control unit 12 on path 21 has a first state which exists when flame is commanded on paths 14 and 15 to be present in the combustion chamber 33, and a second state when flame is not commanded present in combustion chamber 33. It is possible that the standby signal may have its second state during startup and shutdown phases of burner system operation as well as during actual periods of total inactivity in the burner system 20 These phases may also be signalled with a third state of the standby signal. In this context, flame is considered to be present whenever control unit 12 issues commands to implement either pilot or main flame operation phases in combustion chamber 33. The standby signal is considered to have a logical 1 value for its first state and a logical 0 value for its second state.

Among the many different functions of control unit 12 is the detection of flame within combustion chamber 34 by analysis of the flame signal. As mentioned above, a threshold level is defined for the flame signal provided by flame sensor 13, and if the flame signal on path 16 is above this value, flame is assumed to be present. For a particular system with which the invention may be used, the flame sensor 13 provides a current signal which has a threshold level of 0.8 $\mu$amp. If the flame signal is below the threshold value, control unit 12 determines flame is absent. If the operating cycle of the burner system is in a phase where flame is required and flame is determined to be absent, this is a condition requiring that the control unit 12 immediately supply commands on path 14 to close the valves controlling flow of fuel to chamber 33.

In implementing the invention, the software controlling the operation of the microprocessor in system 10 includes instructions executed a regular intervals which cause the microprocessor to function as signal level detectors 17 and 18, AND gates 24 and 25, and oscillators 27 and 28. This implementation allows testing for and indicating flame sensor operation within first and second test ranges, one on each side of the threshold level. The threshold level for the flame signal on path 16 defines on end of both test ranges of flame signal level employed by the signal level detectors 17 and 18. Detector 17 tests for a marginal level larger than the threshold level and detector 18 tests for a marginal level smaller than the threshold level. Which of the test levels is then employed for a particular test depends on the state of the standby signal from control unit 12 on path 21. If the standby signal has its first state which has a value of logical 1 in FIG. 1, this indicates that combustion is present within combustion chamber 33 and the test range used is defined by the first test level, which is larger than the threshold level in the usual situation where the flame signal level increases with increasing radiation from the flame in combustion chamber 33. If the standby signal has its second level shown as a logical 0 in FIG. 1, then the test range is defined by a second test level less than the threshold level. (If an inverse relationship between the flame signal level and the radiation level in chamber 33 exists, then the first and second test levels must be smaller and larger respectively than the threshold level.)

In the commercial system mentioned above, an analog to digital converter 19 receives the flame signal on path 16 and provides a digital signal encoding the flame signal level to detectors 17 and 18. A test level of 1.2 μamp. defines the test range used with the first state of the standby signal as shown for detector 17, and a test level of 0.4 μamp. defines the test range when the standby signal has its second state as shown for detector 18. Detectors 17 and 18 are designed in this embodiment to provide a logical 1 as the output on paths 31 and 32 respectively when the flame signal path 16 level is within the test range defined by the threshold level and the test level indicated, and a logical 0 when outside the specified test range.

The preceding discussion mentioned the use of A/D converter 19 to convert the analog level of the flame signal provided by sensor 13 into a digital representation usable by the detectors 17 and 18. It should also be noted that by use of simple voltage dividers and operational amplifiers, the function of detectors 17 and 18 can be performed in analog circuitry, with outputs having Boolean or logical values suitable for processing by logic elements.

While sensing of an abnormal flame signal condition may be used to automatically shut down the burner system of course, the invention instead includes digital logic designed to provide a warning by flashing an indicator light 41. Shutdown-provoking conditions which are not safety-critical are a nuisance, so a simple warning is deemed preferable. In the preferred embodiment, the indicator light is the flame indicator on the control system panel which is lit when fuel flowing through the main valve is burning.

AND gates 24 and 25 sense abnormal combinations of the standby signal and the outputs of detectors 17 and 18. The standby signal satisfies one input of either gate 24 or 25. If the standby signal has a logical 1 value and the flame signal represents a current between 0.8 and 1.2 μamp, then both inputs of AND gate 24 are satisfied and the output of AND gate 24 on path 22 has a logical 1 value. The conventional representation of an inverted sense for an input is followed for AND gate 25, where the small circle at its input connected to path 21 means that a logical 0 satisfies this input. Therefore, a logical 0 signal on path 21 when the flame signal is between 0.4 and 0.8 μamp. causes both inputs of AND gate 25 to be satisfied, and a logical 1 is provided on path 23.

Oscillators 27 and 28 each provide an oscillating voltage for driving an indicator light 41, and are activated by a logical 1 input at their respective inputs received from paths 22 and 23. It is easiest to provide this oscillating voltage by software within the microprocessor which uses the microprocessor's internal clock to cause interrupts as needed to provide the 1 hz. and 4 hz. voltages needed to flash the indicator light 41. The 1 hz. signal on path 38 is provided when the flame signal on path 16 falls too close to the threshold level when flame is present. A slowly flashing (1 hz.) indicator light 41 is adequate for a situation which will at worst become a nuisance shutdown, where the flame signal indicates no flame when one is present. A signal for flashing indicator light 41 at the more rapid 4 hz. rate is provided by oscillator 28 on path 37. If the flame signal level approaches the threshold level when there is no flame in combustion chamber 33 however, then if the safety systems should also fail, a hazardous situation would exist. The probability for this situation arising is extremely small but because of the magnitude of harm arising from such a double failure, rapid flashing (4 hz.) of indicator light 41 is used to convey a greater sense of urgency to the operator who presumably will promptly schedule maintenance.

Figure 2:
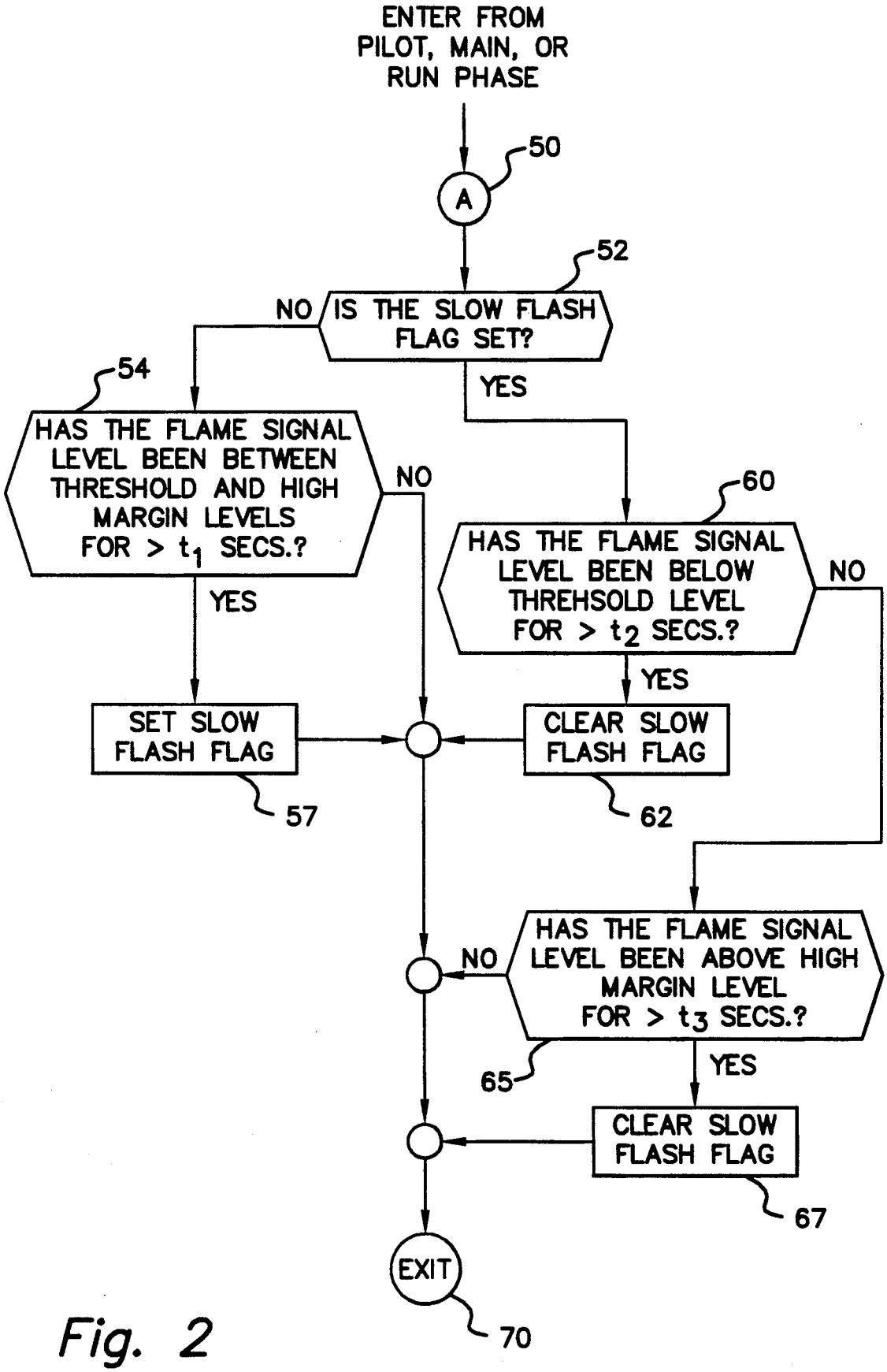
FIG. 2 is a flow chart of software for implementing the preferred embodiment of the invention relating to sensing a degraded flame sensor signal during burner operation.
Figure 3:
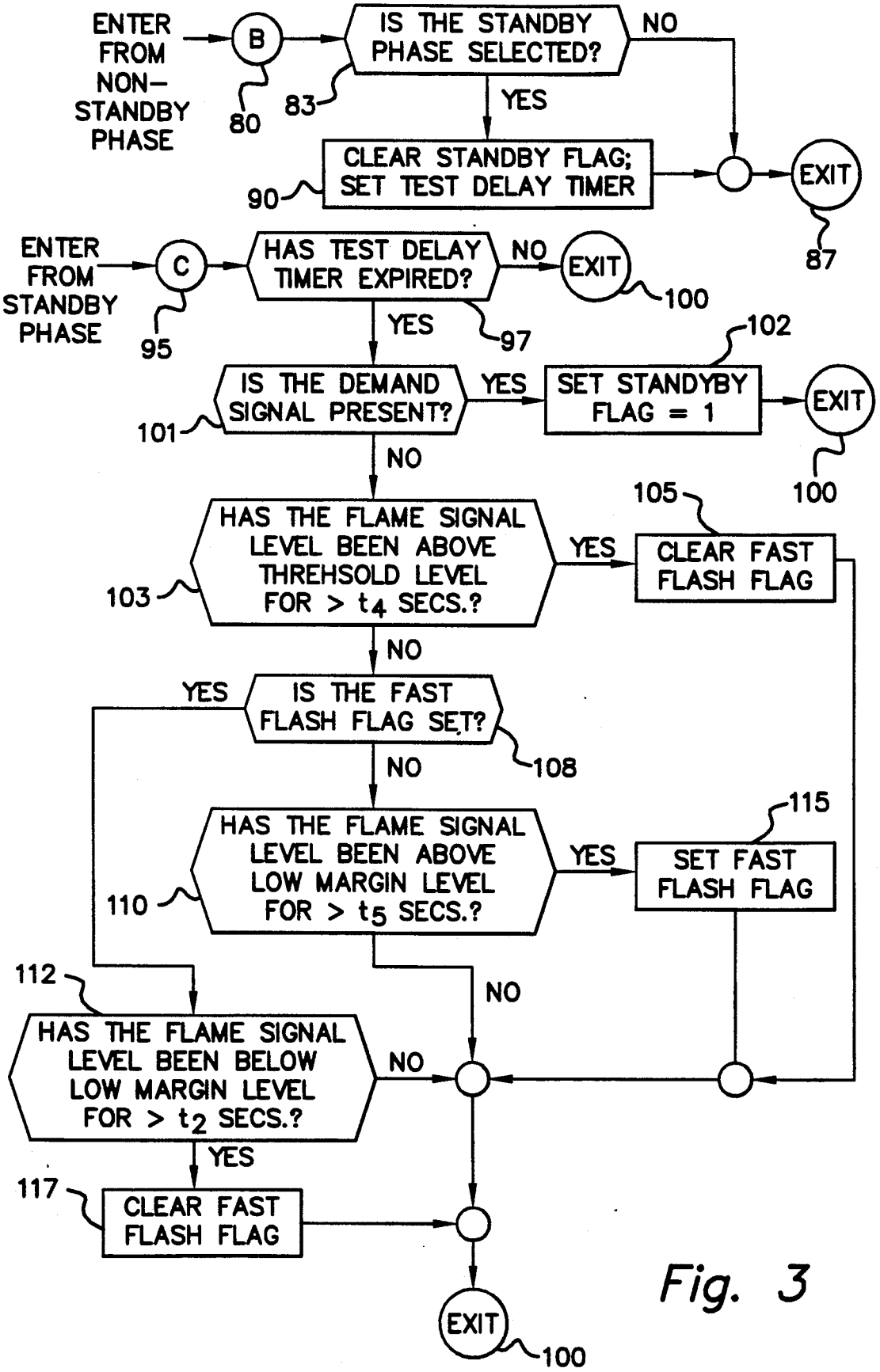
FIG. 3 is a flow chart of software for implementing the preferred embodiment of the invention relating to sensing a degraded flame sensor signal during burner standby.

FIGS. 2 and 3 detail the software logic for implementing the elements shown in FIG. 1 in a microprocessor. In these Figs., rectangular boxes denote instructions in a program which perform data manipulation and arithmetic and logical operations. Hexagonal boxes denote instructions which involve decisions based on the value of a particular data variable or flag which may be changed during execution of instructions in rectangular boxes. Circles are connector elements which designate a change in the usual sequence of instruction execution or entrance to or exit from a set of instructions.

The indicator light 41 of FIG. 1 is under software control in the implementation of FIGS. 2 and 3. In this implementation, an indicator light flip-flop within the microprocessor can be set or cleared by executing appropriate instructions. The set or cleared state of the indicator light flip-flop causes an output channel of the microprocessor to turn the indicator light 41 respectively on or off. A slow flash flag and a fast flash flag are provided, each of which have set and cleared states. The slow flash flag, used when executing the instructions of FIG. 2, indicates when set that indicator light 41 should be flashed slowly, i.e., around once per second. The fast flash flag, used by the instructions of FIG. 3, when set indicates that indicator light 41 should be flashed rapidly, i.e., around four times per second. A preferred way to implement this function in a microprocessor is to set the clock interrupt of the microprocessor to transfer execution of instructions every 125 ms. to an indicator light control instruction set. A clock value, which may be the time of day, is maintained in a clock register which is updated at regular intervals, perhaps every millisecond. If the fast flash and slow flash flags are both cleared, then these instructions cause the indicator light to maintain its current status. If the slow flash flag is set and the clock is at a half second point between full second points, then the indicator light 41 is turned on by a command which sets the indicator light flip-flop. If the clock is at a full second point and the slow flash flag is set, then the indicator light is turned off by clearing the indicator light flip-flop. A similar arrangement exists for the fast flash function, except that the clock interrupt must occur ever 125 ms. for a 4 hz. flashing rate. Note that this is a software implementation of oscillators 27 and 28 shown in FIG. 1. The situation of both the slow and fast flash flags set is an undefined condition that should not occur.

The flame signal level is periodically loaded as a digital value into a register within the microprocessor, and is accessible as an operand to the individual instructions of the software. A set of instructions is executed at sample intervals of preset length, say 30 ms., which maintains first through fourth flame history counters. Each of these counters is incremented by one at the end of each sample interval during which the flame signal level satisfied a predetermined criterion for that counter, and is set to zero (cleared) if the criterion is not satisfied. The criterion for the first history counter is that the flame signal level is at or above the threshold level. The criterion for the second flame history counter is that the flame signal level exceeds a high margin level greater than the threshold level. The second flame history counter is used during the execution of the instructions symbolized in FIG. 2. The criterion for the third flame history counter is that the flame signal level is below the threshold level. The criterion for the fourth flame history counter is the flame signal level is less than a low margin level. The fourth flame history counter is used during the execution of the instructions symbolized in FIG. 3. By examining these flame history counters, it is possible to determine a number of conditions of the recent flame signal history. For the particular burner system mentioned above which uses current level as the flame signal and has a flame signal threshold level of 0.8 μamp., a suitable high margin level is 1.2 μamp. and a suitable low margin level is 0.3–0.4 μamp. Other levels will be required for different burner system designs.

Execution of the instructions symbolized by FIG. 2 corresponds to operation of the FIG. 1 apparatus when the standby signal has its first state, and the burner system phase of operation has a flame in combustion chamber 33. This is symbolized by the legend above connector 50 designating execution of the instructions of FIG. 2 within the microprocessor as transferring from one of the sets of instructions which respectively implement the pilot, main, and run phases of burner system 20 operation. These three phases correspond to the not standby condition of the standby signal on path 21 in FIG. 1 where the standby signal has a logical 1 value.

In the software implementation of FIG. 2, the instructions of decision element 52 test the state of the indicator light flip-flop and if not set, the instructions of decision element 54 are executed next. The instructions of decision element 54 test the value of the first and second flame history counters, and if the first flame history counter shows that the flame signal has been above the threshold level and below the high margin level for at least $t_1$ seconds, this abnormal condition causes the microprocessor to execute the instructions of activity element 57 next. I the preferred burner system, this is a test for the flame signal level falling between 0.8 and 1.2 μamp. for at least 300 ms. Activity element 57 sets the slow flash flag which will cause indicator light 41 to flash slowly, with a one hz. rate presently preferred. Instruction execution then continues with other parts of the program as shown by the exit connector 70. During transition from standby to not standby where flame is present within combustion chamber 33, it takes at least several tens of milliseconds for the flame signal level to change from below the threshold level to above the high margin level of 1.2 μamp. Hence, a window on the order of 300 ms. in duration is provided for the flame signal level to make this transition.

If the test in decision element 52 determines that the slow flash flag is set, then execution is transferred to the instructions of decision element 60. In decision element 60, the third flame history counter is tested and if the flame signal level has been below the threshold level for a predetermined period of time $t_2$ which depends on the flame failure response time of the particular burner system, then the slow flash flag is cleared by executing instructions symbolized by activity element 62 causing indicator light flashing to cease. The FFRT values for typical burner systems run from 0.8 sec. to 4 sec. This condition corresponds to apparent loss of flame, whether intentional or not. Since the marginal or abnormal condition which is tested by the Fig. software elements is not determinable when the flame signal is below the threshold level, the slow flash flag is cleared so as to not continue flashing the indicator light. Execution then transfers to the instructions forming other parts of the program through connector 70.

If the test of decision element 60 is not passed, then the instructions of decision element 65 are executed. These instructions test whether the flame signal level has been above the high margin level for a sufficient period of time ($t_3$) so that the flame can now be considered normal. If not, the normal exit is taken through connector 70. If so, then the slow flash flag is cleared by executing the instructions of activity element 67 and then the normal exit is taken.

Execution of the instructions symbolized by the flow chart of FIG. 3 test flame signal levels when the burner system is in standby phase. The standby phase can be entered literally from any other operating phase of the burner system. Normally, the standby phase is entered either from the postpurge phase if the burner system has a combustion air blower, or from the run phase if the burner has no combustion air blower. However, in unusual situations, it is possible for burner operation to enter standby phase from almost any other phase as the legend on connector B 80 implies. At any rate, decision element 83 symbolizes the decision which may be made in any of man different instruction sequences to enter standby phase. Whenever the decision is made to leave the current phase unchanged, then the exit at connector 87 is taken by the instructions of decision element 83 to continue with other functions of burner system control. If the decision is made to change the current phase to standby, then the instructions of activity element 90 place the burner system in standby phase by clearing the standby flag, and further, set a test delay timer. The length of the test delay timer value depends on the type of burner system involved, and is determined by the maximum length of time required after any of the several phases from which an entry into the standby phase may occur, for the flame signal to be expected to finally drop below the threshold level. For gaseous fuel, this time is a few seconds or less. For oil fuel where there is no postpurge phase, this time is in the tens of seconds. For these reasons, 40 sec. is presently a preferred value for the test delay timer. After executing the instructions of element 90, execution transfers to other activities of burner system control through exit connector 87.

At specified intervals, perhaps every 30 ms., the actual sensor operation testing instructions are executed by transferring execution of instructions to connector C 95 and the elements following. As indicated, this transfer can occur only if the standby phase currently exists, i.e., the standby flag equals zero. Decision element 97 tests the test delay timer set by activity element 90, and if this timer has expired, allows the instructions of decision element 103 to execute. If not, an exit through connector 100 occurs.

The instructions of decision element 101 are next executed. These sense the presence of a demand signal, which is the only condition which can cause a change from the standby phase. if the demand signal is sensed, the instructions of activity element 102 are executed which sets the standby flag to one and then exits to other control instruction execution. If the demand signal is not sensed, then instruction execution passes to decision element 103.

Decision element 103 tests the level of the flame signal to have been above the threshold level for an interval of at least $t_4$ seconds by examining the first flame history counter. If this counter value is greater than $t_4$ seconds, this indicates either that the standby phase of operation no longer exists or a malfunction has occurred. Because the test performed by the instructions symbolized by the elements of FIG. 3 assumes the standby phase, it is necessary to drop the abnormal condition indication, which is done by executing the instructions of activity element 105, which clear the fast flash flag mentioned above. Thus, if the indicator light 41 had been flashing rapidly (which is not certain), clearing the fast flash flag halts rapid flashing of the indicator light. The value $t_4$ provides some measure of tolerance for brief excursions of the flame signal value above the threshold level due to anomalies within the combustion chamber arising from the unpredictability of combustion shutdown. A value of 300 ms. for $t_4$ is preferred.

If the test of the first flame history counter performed by decision element 103 indicates that the flame signal level has been above the threshold level for less than $t_4$ sec. or is below the threshold level, then executing the instructions of decision element 108 follows, which tests the state of the fast flash flag itself. If the fast flash flag is found to be set, execution of instructions passes to decision element 112 which is a low margin test. If the flame signal level has been below the low margin level for at least $t_2$ seconds, then instruction execution passes to activity element 117 which clears the fast flash flag. Recall that $t_2$ is preferably the FRRT used by the instructions of decision element 60 in FIG. 2. At the point of decision element 112, it has been determined that the fast flash flag is in fact set because of the test performed by the instructions of decision element 108. Whether the fast flash flag is cleared or not by the execution of the instructions in elements 112 and 117, instruction execution then passes on to other activities through exit connector 100.

If the fast flash flag is sensed as not set by the instructions of decision element 108, the instructions of decision element 110 are next executed. These instructions test whether the flame signal level has been above the low margin level for as least $t_5$ seconds. Since the test previously performed by the instructions of decision element 103 passed execution to elements 108 and 110 only if the flame signal was either below the threshold level or had been above the threshold level for less than $t_4$ seconds, decision element 110 completes the test for the flame signal level falling between the low margin and threshold levels for more than $t_5$ seconds. If the flame signal level satisfies this inequality, then the fast flash flag is set by the instructions of activity element 115. In either case, instruction execution then continues with other tasks in burner system control by the exit through connector 100.

It can thus be seen that by execution of the instructions of FIGS. 2 and 3, an indicator light 41 which has the primary purpose of indicating a particular condition of the burner system can also be used to indicate other functions related to the light's primary purpose by flashing the light at different rates. In this way, the operator of a burner system can more completely track the operating status and anomalous conditions of the burner system.

We claim:

1. In a burner system of the type having a combustion chamber; a flame sensor mounted in sensing relation to the interior of the combustion chamber and providing a signal having a level changing with changes in the level of radiation from the combustion chamber impinging on the flame sensor and whose signal has a predetermined flame threshold level by which presence of flame by be inferred; and a control unit receiving a demand signal and providing a standby signal whose first state specifies combustion in the combustion chamber and whose second state specifies absence of combustion in the combustion chamber, an improvement for indicating abnormal performance of the flame sensor with a first state of a sensor performance signal, comprising a) a signal level detector receiving the flame sensor signal and providing a test signal responsive to the flame sensor signal falling with a signal level test range defined at one end by a predetermined test level displaced by a predetermined amount from the flame threshold level; and b) logic means receiving the test and standby signals for, responsive to concurrence of a predetermined state of the standby signal and the test signal, issuing the sensor performance signal with its first state, and the sensor performance signal with its second state otherwise.

2. The improvement of claim 1, wherein the signal detector further comprises means for providing the test signal responsive to the flame sensor signal level indicating presence of flame and falling between the threshold level and the predetermined test level, and wherein the logic means includes means for providing the sensor performance signal with its first state responsive to the test signal and the first state of the standby signal.

3. The improvement of claim 2, further comprising a) an indicator element having a power terminal and providing a visual indication responsive to activating power applied to the power terminal; and b) an oscillator receiving the sensor performance signal and responsive to the first state thereof providing cyclic activating power of predetermined cycle rate to the display element's power terminal to activate the display element for a portion of each cycle.

4. The improvement of claim 3, wherein the logic means includes timing means for providing the sensor performance signal with its first state responsive to the test signal falling between the threshold level and the predetermined test level after a predetermined interval elapses.

5. The improvement of claim 3, wherein the oscillator includes means providing a cycle rate of less than one cycle per second.

6. The improvement of claim 2, wherein the flame sensor signal is a varying current level, and wherein the level detector comprises a current sensor having a threshold level of approximately 0.8 μamp. and a test level of approximately 1.2 μamp.

7. The improvement of claim 1, wherein the signal detector further comprises means for providing the test signal responsive to the flame sensor signal level indicating absence of flame and falling between the threshold level and the predetermined test level, and wherein the logic means includes means for providing the sensor performance signal with its first state responsive to the test signal and the second state of the standby signal.

8. The improvement of claim 7, further comprising a) an indicator element having a power terminal and providing a visual indication responsive to activating power applied to the power terminal; and b) an oscillator receiving the sensor performance signal and responsive to the first state thereof providing cyclic activating power of a predetermined cycle rate to the display element's power terminal to activate the display element for a portion of each cycle.

9. The improvement of claim 8, wherein the logic means includes timing means for providing the sensor performance signal with its first state responsive to the test signal falling between the threshold level and the predetermined test level after a predetermined interval elapses.

10. The improvement of claim 8, wherein the oscillator includes means providing a cycle rate of at least two cycles per second.

11. The improvement of claim 7, wherein the flame sensor signal is a varying current level, and wherein the level detector comprises a current sensor having a threshold level of approximately 0.8 μamp. and a test level of approximately 0.4 μamp.

12. In a burner system of the type having a combustion chamber; a flame sensor mounted in sensing relation to the interior of the combustion chamber and providing a signal having a characteristic whose level changes with changes in the level of radiation from the combustion chamber impinging on the flame sensor, and whose signal has a predetermined flame threshold level by which presence of flame may be inferred; and a control system receiving a demand signal and providing a standby signal whose first stage specifies combustion in the combustion chamber and whose second state specifies absence of combustion in the combustion chamber, a method for indicating abnormal performance of the flame sensor with a first state of a sensor performance signal, comprising a) receiving the flame sensor signal and providing a test signal responsive to the flame sensor signal falling within a signal level range defined at one end by a predetermined test level displaced by a predetermined amount from the flame threshold level; and b) receiving the test and standby signals and, responsive to concurrence of a predetermined state of the standby signal and the test signal, issuing the sensor performance signal with its first state, and the sensor performance signal with its second state otherwise.

13. The method of claim 12, further comprising the steps of a) providing the test signal responsive to the flame sensor signal level indicating presence of flame and falling between the threshold level and the predetermined test level, and b) providing the sensor performance signal with its first state responsive to the test signal and the first state of the standby signal.

14. The method of claim 12, further comprising the steps of a) providing the test signal responsive to the flame sensor signal level indicating absence of flame and falling between the threshold level and the predetermined test level, and b) providing the sensor performance signal with its first state responsive to the test signal and the second state of the standby signal.

* * * * *